US011328654B2

(12) United States Patent
Li

(10) Patent No.: US 11,328,654 B2
(45) Date of Patent: May 10, 2022

(54) MULTI-GRAYSCALE PIXEL DRIVING CIRCUIT AND DISPLAY PANEL

(71) Applicant: TCL CHINA STAR OPTOELECTRONICS TECHNOLOGY CO., LTD., Guangdong (CN)

(72) Inventor: Yan Li, Guangdong (CN)

(73) Assignee: TCL CHINA STAR OPTOELECTRONICS TECHNOLOGY CO., LTD., Guangdong (CN)

( * ) Notice: Subject to any disclaimer, the term of this patent is extended or adjusted under 35 U.S.C. 154(b) by 0 days.

(21) Appl. No.: 15/734,577

(22) PCT Filed: Oct. 29, 2020

(86) PCT No.: PCT/CN2020/124659
§ 371 (c)(1),
(2) Date: Dec. 3, 2020

(65) Prior Publication Data

US 2022/0076614 A1 Mar. 10, 2022

(30) Foreign Application Priority Data

Sep. 8, 2020 (CN) ..... 202010936965.7

(51) Int. Cl.
*G09G 3/32* (2016.01)

(52) U.S. Cl.
CPC ..... *G09G 3/32* (2013.01); *G09G 2300/0876* (2013.01); *G09G 2310/08* (2013.01)

(58) Field of Classification Search
CPC ..... G09G 3/32; G09G 2300/0876; G09G 2310/08
See application file for complete search history.

(56) References Cited

U.S. PATENT DOCUMENTS

2013/0286001 A1* 10/2013 Nakano ..... G09G 3/3648 345/212
2017/0076646 A1 3/2017 Gu et al.
2018/0053462 A1* 2/2018 Bae ..... G09G 3/3233
2018/0218681 A1 8/2018 Cai
2019/0122619 A1* 4/2019 Asaoka ..... G09G 3/3607
2019/0347980 A1* 11/2019 Kuo ..... G09G 3/32
(Continued)

FOREIGN PATENT DOCUMENTS

CN 103000132 A 3/2013
CN 103229229 A 7/2013
CN 103971637 A 8/2014
(Continued)

*Primary Examiner* — Andrew Sasinowski
(74) *Attorney, Agent, or Firm* — Mark M. Friedman

(57) ABSTRACT

A multi-grayscale pixel driving circuit and a display panel are provided. A driving module, a light emitting module, and a light emitting control module are coupled in series between a first electrode and a second electrode in the multi-grayscale pixel driving circuit. A light emitting situation of using the driving module and the light emitting control module to control the light emitting module to emit light according to a preset time sequence allows the light emitting module to realize multi-grayscale displays of low grayscale or high grayscale, greatly improving a grayscale number for displaying in the display panel.

14 Claims, 5 Drawing Sheets

(56) References Cited

U.S. PATENT DOCUMENTS

| | | | | |
|---|---|---|---|---|
| 2020/0312232 | A1* | 10/2020 | Yen | G09G 3/32 |
| 2021/0035485 | A1* | 2/2021 | Hoffman | G09G 3/2003 |

FOREIGN PATENT DOCUMENTS

| | | | |
|---|---|---|---|
| CN | 106205495 | A | 12/2016 |
| CN | 110400536 | A | 11/2019 |
| CN | 111312158 | A | 6/2020 |
| CN | 111477172 | A | 7/2020 |

* cited by examiner

MULTI-GRAYSCALE PIXEL DRIVING CIRCUIT AND DISPLAY PANEL

FIELD OF INVENTION

The present disclosure relates to the field of display technology, and particularly relates to a multi-grayscale pixel driving circuit and a display panel.

BACKGROUND OF INVENTION

Currently, each pixel unit of display panels only includes a limited number of light emitting devices. For example, each pixel unit includes three red, green, and blue subpixel circuits, and only one light emitting device is used as a light emitting device on the subpixel circuit of each color for displaying. Moreover, the limited number of the light emitting devices are unable to be regulated by a control module generally. Therefore, the current pixel units can realize a small number of grayscales, are only suitable for low grayscale display, and cannot meet high grayscale display.

The technical problem of the present disclosure is that the current pixel units can only realize a small number of grayscales, are only suitable for low grayscale display, and cannot meet high grayscale display.

SUMMARY OF INVENTION

In order to solve the problem mentioned above, the present disclosure provides a multi-grayscale pixel driving circuit. The multi-grayscale pixel driving circuit includes a driving module, a light emitting module, and a light emitting control module coupled in series between a first electrode and a second electrode, wherein an electric potential of the first electrode is a first electric potential and an electric potential of the second electrode is a second electric potential. Wherein, the driving module and the light emitting module control a light emitting situation of the light emitting module according to a preset time sequence to realize multi-grayscale display being less than a grayscale threshold value or greater than the grayscale threshold value.

In some embodiments, the light emitting module includes a plurality of light emitting units disposed in parallel connection, and each of the light emitting units includes a plurality of light emitting devices in series connection and/or in parallel connection.

In some embodiments, the multi-grayscale pixel driving circuit includes a writing module, a control terminal of the writing module is configured to receive a scanning signal, an input terminal of the writing module is configured to receive a data signal, and an output terminal of the writing module is connected to a control terminal of the driving module.

In some embodiments, the multi-grayscale pixel driving circuit includes a storage module, the output terminal of the writing module and an output terminal of the driving module are respectively connected to a first terminal of the storage module, and a second terminal of the storage module is grounded.

In some embodiments, the light emitting control module includes a plurality of control thin film transistors, a gate electrode of each of the control thin film transistors is configured to receive one corresponding light emitting signal received by the light emitting control module, a source electrode of each of the control thin film transistors is connected to the second electrode, and a drain electrode of each of the control thin film transistors is connected to an input terminal of one corresponding light emitting unit.

In some embodiments, the driving module includes a second thin film transistor, a drain electrode of the second thin film transistor is connected to the first electrode, and a source electrode of the second thin film transistor is connected to an output terminal of one corresponding light emitting unit.

In some embodiments, the writing module includes a third thin film transistor, a gate electrode of the third thin film transistor is configured to receive the scanning signal, a source electrode of the third thin film transistor is configured to receive the data signal, a drain electrode of the third thin film transistor is connected to the gate electrode of the second thin film transistor.

In some embodiments, the storage module includes a storage capacitor, a first terminal of the storage capacitor is connected to the gate electrode of the second thin film transistor and the drain electrode of the third thin film transistor respectively, and a second terminal of the storage capacitor is grounded.

In addition, the present disclosure further provides a display panel. The display panel includes the multi-grayscale pixel driving circuit mentioned above. The multi-grayscale pixel driving circuit includes a driving module, a light emitting module, and a light emitting control module coupled in series between a first electrode and a second electrode, and an electric potential of the first electrode is a first electric potential and an electric potential of the second electrode is a second electric potential. Wherein, the driving module and the light emitting module control a light emitting situation of the light emitting module according to a preset time sequence to realize multi-grayscale display being less than a grayscale threshold value or greater than the grayscale threshold value.

In some embodiments, the light emitting module includes a plurality of light emitting units disposed in parallel connection, and each of the light emitting units includes a plurality of light emitting devices in series connection and/or in parallel connection. In some embodiments, the light emitting module includes a plurality of light emitting units disposed in parallel connection, and each of the light emitting units includes a plurality of light emitting devices in series connection and/or in parallel connection.

In some embodiments, the multi-grayscale pixel driving circuit includes a writing module, a control terminal of the writing module is configured to receive a scanning signal, an input terminal of the writing module is configured to receive a data signal, and an output terminal of the writing module is connected to a control terminal of the driving module.

In some embodiments, the multi-grayscale pixel driving circuit includes a storage module, the output terminal of the writing module and an output terminal of the driving module are respectively connected to a first terminal of the storage module, and a second terminal of the storage module is grounded.

In some embodiments, the light emitting control module includes a plurality of control thin film transistors, a gate electrode of each of the control thin film transistors is configured to receive one corresponding light emitting signal received by the light emitting control module, a source electrode of each of the control thin film transistors is connected to the second electrode, and a drain electrode of each of the control thin film transistors is connected to an input terminal of one corresponding light emitting unit.

In some embodiments, the driving module includes a second thin film transistor, a drain electrode of the second thin film transistor is connected to the first electrode, and a source electrode of the second thin film transistor is connected to an output terminal of one corresponding light emitting unit.

In some embodiments, the writing module includes a third thin film transistor, a gate electrode of the third thin film transistor is configured to receive the scanning signal, a source electrode of the third thin film transistor is configured to receive the data signal, a drain electrode of the third thin film transistor is connected to the gate electrode of the second thin film transistor.

In some embodiments, the storage module includes a storage capacitor, a first terminal of the storage capacitor is connected to the gate electrode of the second thin film transistor and the drain electrode of the third thin film transistor respectively, and a second terminal of the storage capacitor is grounded.

In the multi-grayscale pixel driving circuit and the display panel provided by the present disclosure, the driving module, the light emitting module, and the light emitting control module are coupled in series between the first electrode and the second electrode in the multi-grayscale pixel driving circuit. The electric potential of the first electrode is the first electric potential, and the electric potential of the second electrode is the second electric potential. A situation of using the driving module and the light emitting control module to control the light emitting module to emit light according to the preset time sequence allows the light emitting module to realize multi-grayscale displays with low grayscale or high grayscale. Compared to the prior art, which can only realize low grayscale display, the present disclosure greatly improves a grayscale number for displaying, and using the multi-grayscale pixel driving circuit in the display panel can realize display with more grayscale numbers.

DESCRIPTION OF DRAWINGS

FIG. 5 (*b*) is a time sequence schematic diagram of high grayscale of the multi-grayscale pixel driving circuit provided by one embodiment of the present disclosure.

DETAILED DESCRIPTION OF PREFERRED EMBODIMENTS

Figure 1:
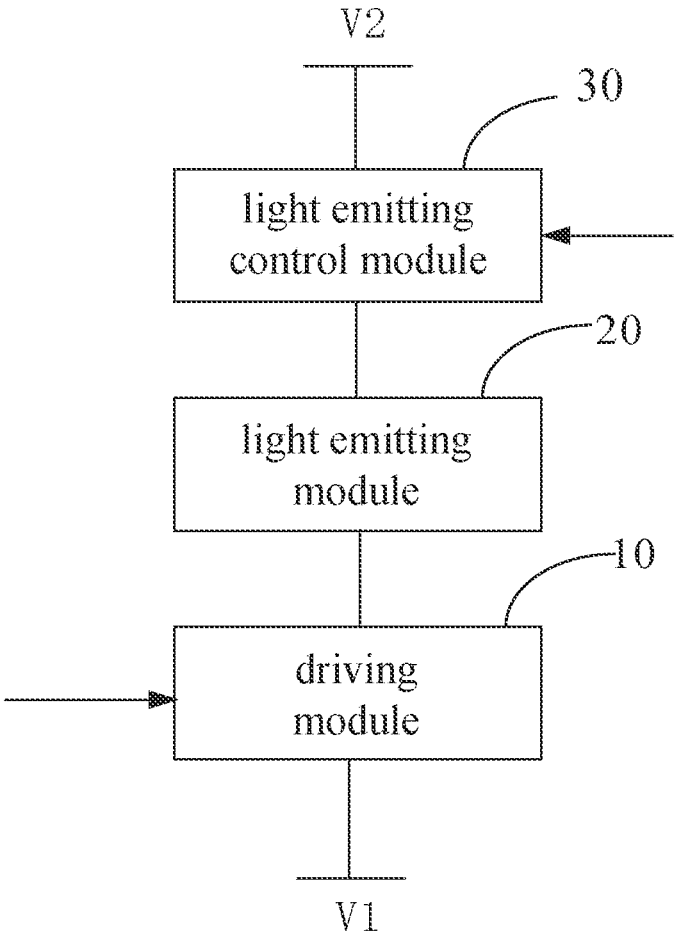
FIG. 1 is a first structural schematic diagram of a multi-grayscale pixel driving circuit provided by one embodiment of the present disclosure.

For making the purposes, technical solutions and effects of the present disclosure be clearer and more definite, the present disclosure will be further described in detail below. It should be understood that the specific embodiments described herein are merely for explaining the present disclosure and are not intended to limit the present disclosure.

In all embodiments of the present disclosure, in order to distinguish two other electrodes of a transistor except gate electrode, one of the electrodes is indicated as a source electrode, and another electrodes is indicated as a drain electrode. Because the source electrode and the drain electrode of the transistor are symmetrical, the source electrode and the drain electrode are exchangeable. According to forms illustrated in the drawings, a middle terminal of the transistor is defined as the gate electrode, a signal input terminal is defined as the source electrode, and a signal output terminal is defined as the drain electrode. In addition, the transistor used in all embodiments of the present disclosure may include P-type and/or N-type switching transistors. Wherein, the gate electrode of the P-type transistor is turned on in a low electric potential and is turned off in a high electric potential, and the gate electrode of the N-type transistor is turned on in a high electric potential and is turned off in a low electric potential.

Figure 2:
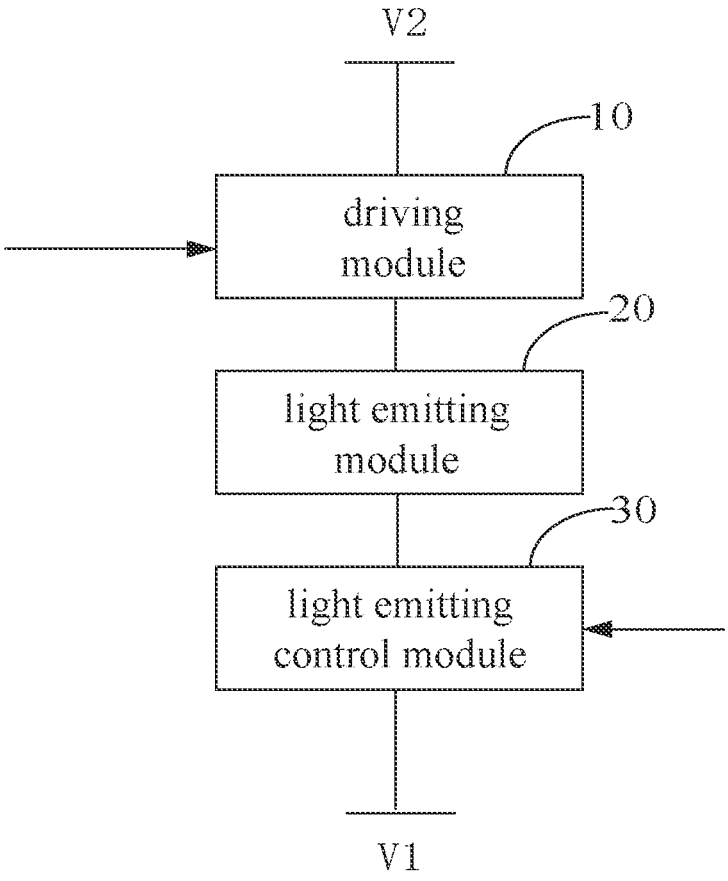
FIG. 2 is a second structural schematic diagram of the multi-grayscale pixel driving circuit provided by one embodiment of the present disclosure.

FIG. 1 is a first structural schematic diagram of a multi-grayscale pixel driving circuit provided by one embodiment of the present disclosure. FIG. 2 is a second structural schematic diagram of the multi-grayscale pixel driving circuit provided by one embodiment of the present disclosure. As illustrated in FIG. 1 or FIG. 2, the present disclosure provides a multi-grayscale pixel driving circuit. The multi-grayscale pixel driving circuit includes a driving module 10, a light emitting module 20, and a light emitting control module 30 coupled in series between a first electrode and a second electrode. An electric potential of the first electrode is a first electric potential V1 and an electric potential of the second electrode is a second electric potential V2. Wherein, the driving module 10 and the light emitting module control a light emitting situation of the light emitting module according to a preset time sequence to realize multi-grayscale display being less than a grayscale threshold value or greater than the grayscale threshold value.

Specifically, the control module 10 is configured to control an electric current flowing through the first electrode and the second electrode. The light emitting control module 30 is configured to control a light emitting situation of light emitting devices in the light emitting module 20. The driving module 10 and the light emitting control module 30 coordinate with each other according to the preset time sequence to allow the light emitting module 20 to realize the multi-grayscale display less than the grayscale threshold value or greater than the grayscale threshold value.

It should be noted that the grayscale threshold value can be selected from grayscale values between 0 to 255 according to an actual situation. For example, if 50 is selected as the grayscale threshold value, then the grayscale values lower than 50 are low grayscale values, and the grayscale values not less than 50 are high grayscale values.

It can be understood that a series connection sequence of the driving module 10, the light emitting module 20, and the light emitting control module 30 between the first electrode and the second electrode is not limited. FIG. 1 and FIG. 2 are examples of two series connection relations of the driving module 10, the light emitting module 20, and the light emitting control module 30 between the first electrode and the second electrode. In FIG. 1, the driving module 10, the light emitting module 20, and the light emitting control module 30 are coupled in series between the first electrode and the second electrode in sequence. In FIG. 2, the light emitting control module 30, the light emitting module 20, and the driving module 10 are coupled in series between the first electrode and the second electrode in sequence. The following embodiments are expanded on the basis of FIG. 1, but embodiments expanded on the basis of FIG. 2 are also within the protection scope of the present disclosure.

In the multi-grayscale pixel driving circuit provided by the present disclosure, disposing the driving module 10, the light emitting module 20, and the light emitting control module 30 coupled in series between the first electrode and the second electrode and using the driving module 10 and the light emitting control module 30 to control the light emitting situation of the light emitting module 20 according to the preset time sequence make the light emitting module to realize multi grayscale display with the high grayscale or the low grayscale, greatly improving the grayscale numbers being able to display.

Figure 3:
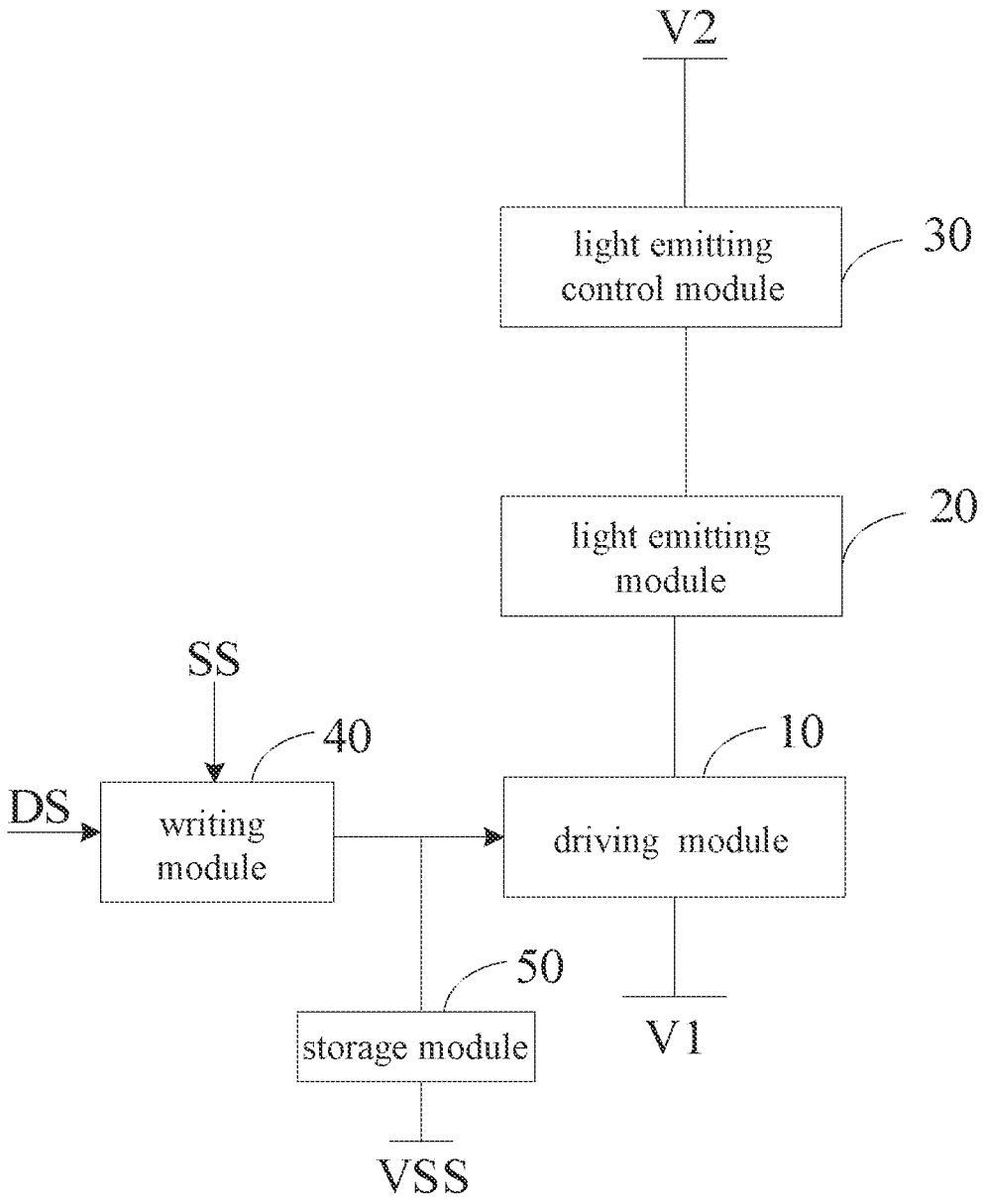
FIG. 3 is a third structural schematic diagram of the multi-grayscale pixel driving circuit provided by one embodiment of the present disclosure.

FIG. 3 is a third structural schematic diagram of the multi-grayscale pixel driving circuit provided by one embodiment of the present disclosure. As illustrated on FIG. 3, the multi-grayscale pixel driving circuit further includes a writing module 40. A control terminal of the writing module 40 is configured to receive a scanning signal SS. An input terminal of the writing module 40 is configured to receive a data signal DS. An output terminal of the writing module 40 is connected to a control terminal of the driving module 10.

As illustrated in FIG. 3, the multi-grayscale pixel driving circuit further includes a storage module 50. The output terminal of the writing module 40 and an output terminal of the driving module 10 are respectively connected to a first terminal of the storage module 50, and a second terminal of the storage module 50 is grounded.

Furthermore, the light emitting module 20 further includes a plurality of light emitting units disposed in parallel connection. Each of the light emitting units includes a plurality of light emitting devices in series connection and/or in parallel connection.

Figure 4:
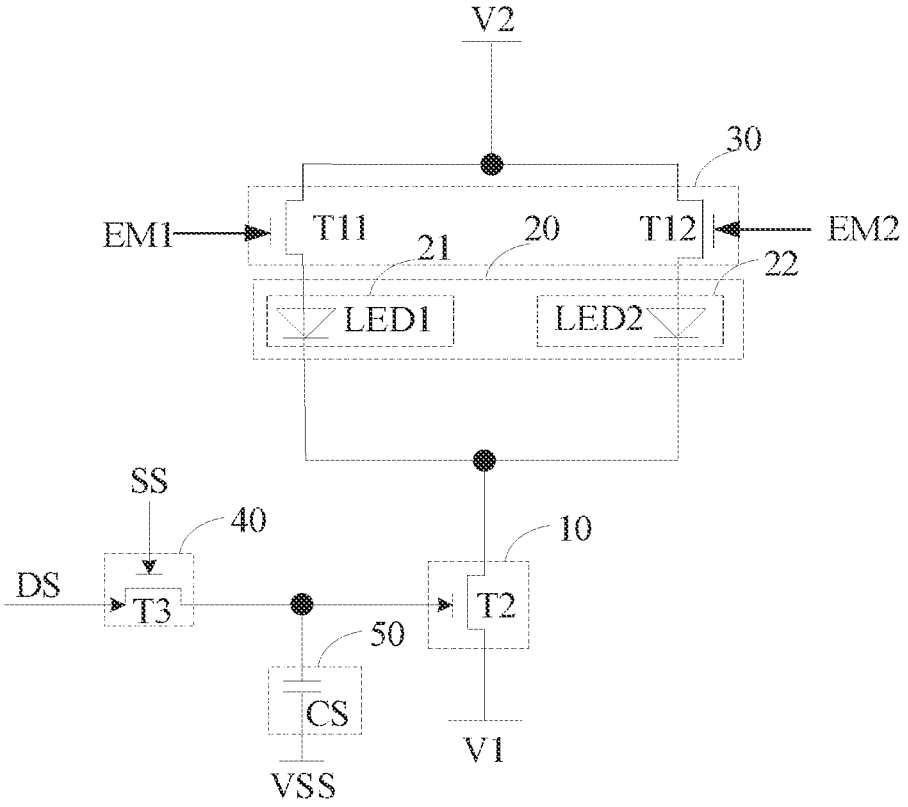
FIG. 4 is a specific structural schematic diagram of the multi-grayscale pixel driving circuit provided by one embodiment of the present disclosure.

FIG. 4 is a specific structural schematic diagram of the multi-grayscale pixel driving circuit provided by one embodiment of the present disclosure. FIG. 4 is an example that the light emitting module 20 includes a first light emitting unit 21 and a second light emitting unit 22 disposed in parallel connection, the first light emitting unit 21 only includes one light emitting device LED1, and the second light emitting unit 22 only includes one light emitting device LED2.

It should be noted that each light emitting unit can actually include several light emitting devices (LEDs) in series connection and/or in parallel connection, that is, the several LEDs can be combined in series connection or in parallel connection according to actual needs to realize different display effects.

Furthermore, the light emitting control module 30 includes a plurality of control thin film transistors T1 (not shown in the figures). A gate electrode of each of the control thin film transistors T1 is configured to receive one corresponding light emitting signal EM received by the light emitting control module 30. A source electrode of each of the control thin film transistors T1 is connected to the second electrode. A drain electrode of each of the control thin film transistors T1 is connected to an input terminal of one corresponding light emitting unit. Therefore, each control thin film transistor T1 controls a switch of one corresponding light emitting unit of the light emitting module 20 according to one light emitting signal EM of the light emitting control module 30.

It can be understood that in high grayscale display or in low grayscale display, part of the light emitting units can be made to keep emitting light all the time, that is, the light emitting signals EM received by the control thin film transistors T1 connected to this part of the light emitting units maintain a constant electric potential, making the control thin film transistors T1 between this part of the light emitting units and the second electrode to keep turning on all the time. Or, the control thin film transistors T1 connected to this part of the light emitting units are omitted to make this part of the light emitting units directly connect to the second electrode, and connecting to the second electrode through corresponding control thin film transistors T1 are not needed, simplifying the circuit structure.

As illustrated in FIG. 4, the light emitting control module 30 includes two control thin film transistors T1 (a first control thin film transistor T11 and a second control thin film transistor T12). Wherein, the first control thin film transistor T1 controls a switch of the first light emitting unit 21 according to a first light emitting signal EM1, and a second light emitting unit T12 controls a switch of the second light emitting unit 22 according to a second light emitting signal EM2.

Combined with FIG. 3 and FIG. 4, the driving module 10 includes the second thin film transistor T2. A drain electrode of the second thin film transistor T2 is connected to the first electrode. A source electrode of the second thin film transistor T2 is connected to an output terminal of one corresponding light emitting unit.

Combined with FIG. 3 and FIG. 4, the writing module 40 includes a third thin film transistor T3. A gate electrode of the third thin film transistor T3 is configured to receive the scanning signal SS. A source electrode of the third thin film transistor T3 is configured to receive the data signal DS. A drain electrode of the third thin film transistor T3 is connected to the gate electrode of the second thin film transistor.

Combined with FIG. 3 and FIG. 4, the storage module 50 includes a storage capacitor CS. A first terminal of the storage capacitor CS is connected to a gate electrode of the second thin film transistor T2 and the drain electrode of the third thin film transistor T3 respectively, and a second terminal of the storage capacitor CS is grounded.

Figure 5:
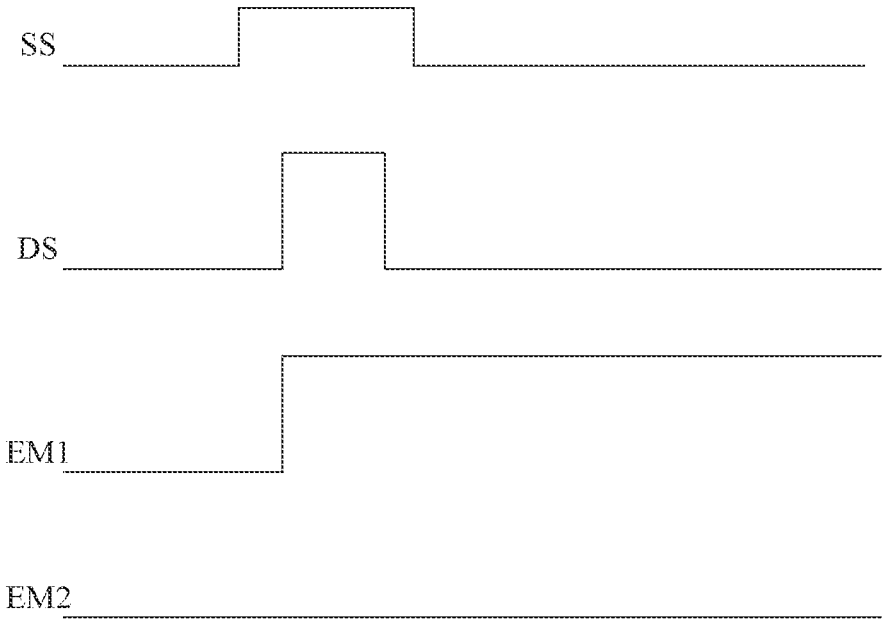
FIG. 5 (*a*) is a time sequence schematic diagram of low grayscale of the multi-grayscale pixel driving circuit provided by one embodiment of the present disclosure.
Figure 5:
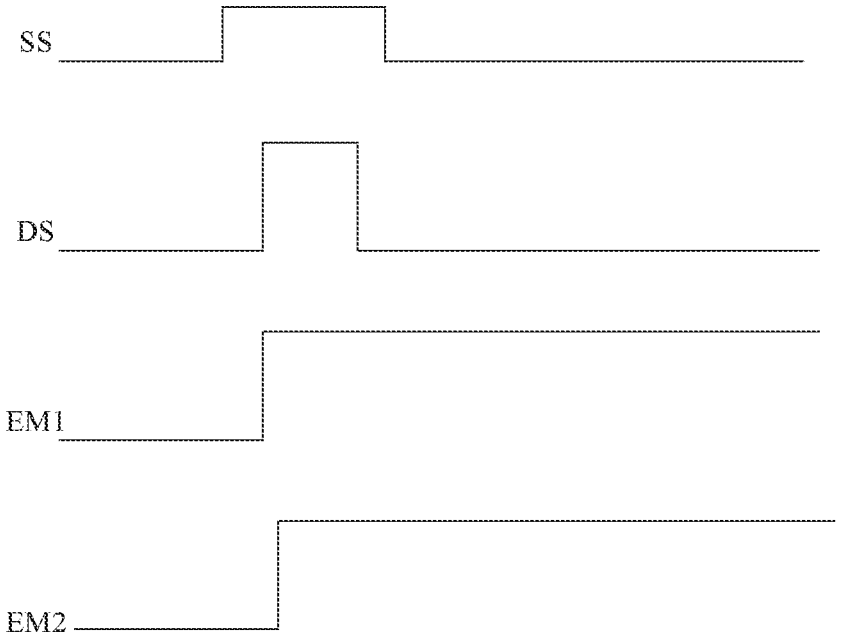

Taking FIG. 4 as an example, assuming that all the thin film transistors in FIG. 4 are N-type thin film transistors, a working process of the multi-grayscale pixel driving circuit provided by the present disclosure is:

FIG. 5 (*a*) is a time sequence schematic diagram of low grayscale of the multi-grayscale pixel driving circuit provided by one embodiment of the present disclosure. Combined with FIG. 4 and FIG. 5 (*a*), when the scanning signal SS is at high electric potential, the third thin film transistor T3 is turned on, and the data signal DS with high electric potential is written into the storage capacitor CS to make the second thin film transistor T2 be turned on. At this time, the first light emitting signal EM1 is at high electric potential, making the first control thin film transistor T11 be turned on, the first light emitting device LED1 of the first light emitting unit 21 emits light, while the second light emitting signal EM2 is low electric potential, making the second control thin film transistor T12 be turned off, the second light emitting device LED2 of the second light emitting unit 22 does not emit light, thereby realizing low grayscale display.

FIG. 5 (*b*) is a time sequence schematic diagram of high grayscale of the multi-grayscale pixel driving circuit provided by one embodiment of the present disclosure. Combined with FIG. 4 and FIG. 5 (*b*), when the scanning signal SS is at high electric potential, the third thin film transistor T3 is turned on, and the data signal DS with high electric potential is written into the storage capacitor CS to make the second thin film transistor T2 be turned on. At this time, the first light emitting signal EM1 is at high electric potential, making the first control thin film transistor T11 be turned on, the first light emitting device LED1 of the first light emitting unit 21 emits light, while the second light emitting signal EM2 is low electric potential, making the second control thin film transistor T12 be turned on, the second light emitting device LED2 of the second light emitting unit 22 emits light, thereby realizing high grayscale display.

Therefore, through the first control thin film transistor T11 under the control of the first light emitting signal EM1 and the second control thin film transistor T12 under the control of the second light emitting signal EM2, the low grayscale display is realized when only one first light emitting device LED1 emits light, and the high grayscale display is realized when the first light emitting device LED1 and the second light emitting device LED2 emit light simultaneously. Therefore, compared to the prior art which can only realize the first light emitting device LED1 to emit light, the grayscale number is improved. Furthermore, the first light emitting device LED1 keeps emitting light all the time, so the first control thin film transistor T11 can be omitted to make the first light emitting device LED1 directly connect to the second electrode to simplify the circuit structure.

It should be noted that on the basis of FIG. 4, modified embodiments from the aforesaid embodiments of the light emitting module 20 and the light emitting control module 30 are all within protection scope of the present disclosure.

Figure 6:
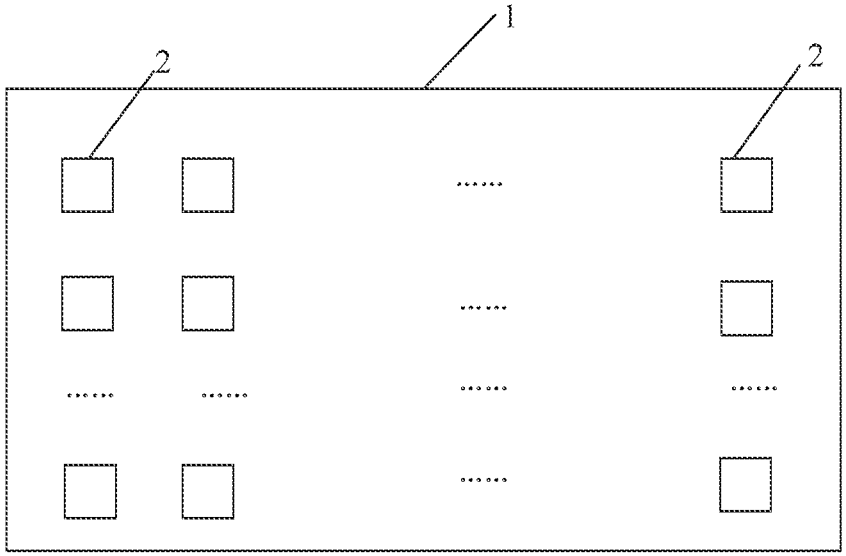
FIG. 6 is a structural schematic diagram of a display panel provided by one embodiment of the present disclosure.

FIG. 6 is a structural schematic diagram of a display panel provided by one embodiment of the present disclosure. As illustrated in FIG. 6, one embodiment of the present disclosure further provides a display panel 1. The display panel 1 includes the multi-grayscale pixel driving circuit 2 of the embodiments mentioned above. The plurality of the multi-grayscale pixel driving circuits 2 are arranged in an array manner in the display panel. The display panel 1 has same structures and beneficial effects of the multi-grayscale pixel driving circuit 2. Because the structures and beneficial effects of the multi-grayscale pixel driving circuit 2 have been described in detail in the embodiments mentioned above, redundant description will not be mentioned herein.

It can be understood that each multi-grayscale pixel driving circuit acts as one subpixel circuit, every three multi-grayscale pixel driving circuits form one pixel unit, and LEDs of the three multi-grayscale pixel driving circuits can emit red, green, and blue lights respectively to realize the multi grayscale display with every colors from the red, green, and blue colors, thereby realizing multi grayscale display of each pixel unit.

It can be understood, that for those of ordinary skill in the art, various other corresponding changes and modifications can be made according to the technical solutions and technical ideas of the present disclosure, and all such changes and modifications are intended to fall within the scope of protection of the claims of the present disclosure.

What is claimed is:

1. A multi-grayscale pixel driving circuit, comprising a driving module, a light emitting module, a light emitting control module coupled in series between a first electrode and a second electrode, and a writing module, wherein an electric potential of the first electrode is a first electric potential and an electric potential of the second electrode is a second electric potential;

wherein the driving module and the light emitting module control a light emitting situation of the light emitting module according to a preset time sequence to realize multi-grayscale display being less than a grayscale threshold value or greater than the grayscale threshold value, and wherein the multi-grayscale pixel driving circuit comprises a writing module, a control terminal of the writing module is configured to receive a scanning signal, an input terminal of the writing module is configured to receive a data signal, and an output terminal of the writing module is connected to a control terminal of the driving module.

2. The multi-grayscale pixel driving circuit as claimed in claim 1, wherein the light emitting module comprises a plurality of light emitting units disposed in parallel connection, each of the light emitting units comprises a plurality of light emitting devices, and the plurality of light emitting devices are in series connection or in parallel connection, or a part of the plurality of light emitting devices are in series connection and another part of the plurality of light emitting devices are in parallel connection.

3. The multi-grayscale pixel driving circuit as claimed in claim 2, wherein the light emitting control module comprises a plurality of control thin film transistors, a gate electrode of each of the control thin film transistors is configured to receive one corresponding light emitting signal received by the light emitting control module, a source electrode of each of the control thin film transistors is connected to the second electrode, a drain electrode of each of the control thin film transistors is connected to an input terminal of one corresponding light emitting unit, and the control thin film transistors are first thin film transistors.

4. The multi-grayscale pixel driving circuit as claimed in claim 1, wherein the multi-grayscale pixel driving circuit comprises a storage module, the output terminal of the writing module and an output terminal of the driving module are respectively connected to a first terminal of the storage module, and a second terminal of the storage module is grounded.

5. The multi-grayscale pixel driving circuit as claimed in claim 4, wherein the driving module comprises a second thin film transistor, a drain electrode of the second thin film transistor is connected to the first electrode, and a source electrode of the second thin film transistor is connected to an output terminal of one corresponding light emitting unit.

6. The multi-grayscale pixel driving circuit as claimed in claim 5, wherein the writing module comprises a third thin film transistor, a gate electrode of the third thin film transistor is configured to receive the scanning signal, a source electrode of the third thin film transistor is configured to receive the data signal, a drain electrode of the third thin film transistor is connected to the gate electrode of the second thin film transistor.

7. The multi-grayscale pixel driving circuit as claimed in claim 6, wherein the storage module comprises a storage capacitor, a first terminal of the storage capacitor is connected to the gate electrode of the second thin film transistor and the drain electrode of the third thin film transistor respectively, and a second terminal of the storage capacitor is grounded.

8. A display panel, comprising a multi-grayscale pixel driving circuit, wherein the multi-grayscale pixel driving circuit comprises a driving module, a light emitting module, a light emitting control module coupled in series between a first electrode and a second electrode, and a writing module, and an electric potential of the first electrode is a first electric potential and an electric potential of the second electrode is a second electric potential;

wherein the driving module and the light emitting module control a light emitting situation of the light emitting module according to a preset time sequence to realize multi-grayscale display being less than a grayscale threshold value or greater than the grayscale threshold value, and wherein a control terminal of the writing module is configured to receive a scanning signal, an input terminal of the writing module is configured to receive a data signal, and an output terminal of the writing module is connected to a control terminal of the driving module.

9. The display panel as claimed in claim 8, wherein the light emitting module comprises a plurality of light emitting units disposed in parallel connection, each of the light emitting units comprises a plurality of light emitting devices and the plurality of light emitting devices are in series connection or in parallel connection, or a part of the plurality of light emitting devices are in series connection and another part of the plurality of light emitting devices are in parallel connection.

10. The display panel as claimed in claim 9, wherein the multi-grayscale pixel driving circuit comprises a storage module, the output terminal of the writing module and an output terminal of the driving module are respectively connected to a first terminal of the storage module, and a second terminal of the storage module is grounded.

11. The display panel as claimed in claim 10, wherein the driving module comprises a second thin film transistor, a drain electrode of the second thin film transistor is connected to the first electrode, and a source electrode of the second thin film transistor is connected to an output terminal of one corresponding light emitting unit.

12. The display panel as claimed in claim 11, wherein the writing module comprises a third thin film transistor, a gate electrode of the third thin film transistor is configured to receive the scanning signal, a source electrode of the third thin film transistor is configured to receive the data signal, a drain electrode of the third thin film transistor is connected to the gate electrode of the second thin film transistor.

13. The display panel as claimed in claim 12, wherein the storage module comprises a storage capacitor, a first terminal of the storage capacitor is connected to the gate electrode of the second thin film transistor and the drain electrode of the third thin film transistor respectively, and a second terminal of the storage capacitor is grounded.

14. The display panel as claimed in claim 9, wherein the light emitting control module comprises a plurality of control thin film transistors, a gate electrode of each of the control thin film transistors is configured to receive one corresponding light emitting signal received by the light emitting control module, a source electrode of each of the control thin film transistors is connected to the second electrode, a drain electrode of each of the control thin film transistors is connected to an input terminal of one corresponding light emitting unit, and the control thin film transistors are first thin film transistors.

* * * * *